United States Patent [19]

Koskimies

[11] 4,104,116

[45] Aug. 1, 1978

[54] HEADBOX FLOW CONTROLS

[75] Inventor: Jouni Koskimies, Jyvaskyla, Finland

[73] Assignee: Valmet Oy, Helsinki, Finland

[21] Appl. No.: 826,271

[22] Filed: Aug. 19, 1977

[30] Foreign Application Priority Data

Aug. 20, 1976 [FI] Finland ..... 762393

[51] Int. Cl.[2] ..... D21E 1/02

[52] U.S. Cl. ..... 162/343; 162/216

[58] Field of Search ..... 162/343, 216

[56] References Cited

U.S. PATENT DOCUMENTS

| | | | |
|---|---|---|---|
| 3,216,892 | 11/1965 | Wahlstrom et al. | 162/343 |
| 3,328,236 | 6/1967 | Burgess, Jr. et al. | 162/343 X |
| 3,514,372 | 5/1970 | Boyce et al. | 162/343 X |
| 3,846,229 | 11/1974 | Kallmes | 162/343 X |

*Primary Examiner*—Richard V. Fisher

*Attorney, Agent, or Firm*—Steinberg & Blake

[57] ABSTRACT

A headbox system for a paper-manufacturing machine includes an equalizing chamber the interior of which receives pulp stock from any suitable source and delivers this pulp stock to an outlet end of the equalizing chamber. A plurality of elongated passages, situated in a horizontal plane, respectively have inlet ends which communicate with the outlet end of the equalizing chamber to receive a pulp stock therefrom, the stock flowing along the interiors of these passages toward a slice of the headbox. A throttling plate is situated between the outlet end of the equalizing chamber and the inlet ends of the passages for throttling the flow of pulp stock from the equalizing chamber into these passages. A plurality of strips extend along the interior of the equalizing chamber and through the throttling plate into and along the interiors of the passages for guiding the pulp stock flowing through the throttling plate in such a way as to prevent variations in flow from being created by changes in the direction at which the pulp stock passes through the throttling plate into the passages.

16 Claims, 12 Drawing Figures

B – B

A – A

HEADBOX FLOW CONTROLS

BACKGROUND OF THE INVENTION

The present invention relates to paper-manufacturing machines, and in particular to headbox systems for such machines.

The present invention relates particularly to structure for controlling the manner in which pulp stock flows in a hydraulic headbox.

The present invention is concerned particularly with a system for stabilizing the pulp stock flow in a hydraulic headbox which includes, sequentially in the direction of flow, starting at a distribution pipe system, a flow equalizing chamber, a system of turbulence passages, a tapering lip-cone passage portion extending from the latter passages toward the slice, and a flow-restriction location formed by a perforated plate situated at the junction between the equalizing chamber and the above system of turbulence passages.

Modern hydraulic headboxes utilized in paper machines, as known in the prior art, consist in general of a distribution header and distribution pipe system, a flow equalizing chamber, a system of turbulence passages and a lip-cone which is provided with an adjustable lip slice from which the pulp stock flow discharges onto the forming wire.

However, in the conventional equalizing chamber of such a headbox system, particularly if the latter chamber is of sufficient length, there is induced a state of flow which with time varies in its direction, in a relatively slow manner, before the flowing pulp stock reaches the system of turbulence passages. These directional variations form a considerable source of disturbance with respect to stability of the lip flow of the slice of the headbox. The physical phenomena which create these disturbances are referred to in greater detail below.

In connection with the prior art, in order to stabilize the headbox flow, it is known to guide the flowing pulp stock into the equalizing chamber by way of an array of several rows of tubes, so as to attempt to reduce in this way the variations in the direction of flow. Such a construction, however, has the drawback that the corrective effect achieved by way of this construction will be of a gradually diminishing magnitude as the equalizing chamber becomes gradually longer. In other words with such constructions the length of equalizing chamber, in the direction of flow, varies inversely with the corrective effect achieved by such a construction.

It is also known to provide equalizing chambers with Venturi-type throttling systems or with a set of plates which while extending in the machine direction nevertheless permit a transverse flow through gaps of these plates. Both of these types of systems do achieve some correction of directional variation in the flow, but the extent of correction is not sufficiently great to inhibit the change in the direction of flow to the desired extent.

It is furthermore known to place the interior of equalizing chamber in communication with an air-cushion type of damper. Since, however, the disturbance does not occur substantially as a pressure disturbance, the air-damping effect provides hardly any correction in the directional flow disturbance, regardless of whether or not the system of turbulence passages and the equalizing chamber have between themselves a certain angle. It has also been found that with an air-cushion damper acting at the intermediate chamber there may be within a certain flow range an undesirable increase in the instability of the flow at the lip or slice.

It is furthermore known to increase the extent of pressure drop in the system of turbulence passages by reducing the open cross-section thereof or by increasing the frictional surface area of the turbulence passage system. Reduction of the cross-section of flow at the input or inlet edge of the system of turbulence passages implies a reduction in the geometric aperture ratio and, as a result, a greater sensitivity with respect to variations of the constriction coefficient, in connection with which reference may be made to the formula presented below. There is experimental evidence which supports this latter effect. An appreciable enlargement of the area of the friction surface of the system of passages results in a construction which is prohibitively expensive.

SUMMARY OF THE INVENTION

It is accordingly a primary object of the present invention to provide a system of the above general type which will avoid the above drawbacks.

Thus, it is a primary object of the present invention to provide a construction according to which the sources of disturbances resulting from changes in direction of flow of the pulp stock can be substantially eliminated in a highly efficient manner so that the headbox flow will be effectively stabilized.

It is in addition an object of the present invention to provide a construction which will achieve these results without requiring any moving parts and instead requiring only relatively simple elements to be assembled together and to remain stationary with respect to each other in their assembled condition in order to achieve the stabilized flow.

In accordance with the invention, in order to prevent variations in the flow rate, which would result from changes in the direction of flow from the equalizing chamber into the system of turbulence passages, there are provided guiding strips or equivalent guiding members, forming a flow-guide means, which extend parallel to the main direction of flow, through the throttling means situated between the outlet end of the equalizing chamber and the inlet ends of the turbulence passages, this throttling means being in the form of a perforated plate, for example.

Thus, in accordance with the invention the headbox system of the paper-manufacturing machine includes an equalizing chamber means having an outlet end and an interior for receiving pulp stock, from a source such as one or more distribution pipes, and delivering the pulp stock to this outlet end. A slice is situated distant from the equalizing chamber means, and a plurality of elongated passage-forming means are situated beside each other in a substantially horizontal plane and respectively have inlet ends communicating with the outlet end of the equalizing chamber means for receiving therefrom pulp stock to be directed by the plurality of passage-forming means toward the slice. A throttling means is situated between the outlet end of the chamber means and the inlet ends of the passage-forming means for throttling the flow of pulp stock from the equalizing chamber means into the plurality of passage-forming means. A flow-guide means extends along the interior of equalizing chamber means, through the throttling means, and along at least some of the passage-forming means for guiding the pulp stock flowing from the equalizing chamber means into and along the plurality of passage-forming means and for preventing creation of flow-rate variations from changes in the direction of flow of pulp stock from the equalizing chamber means into the plurality of passage-forming means.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
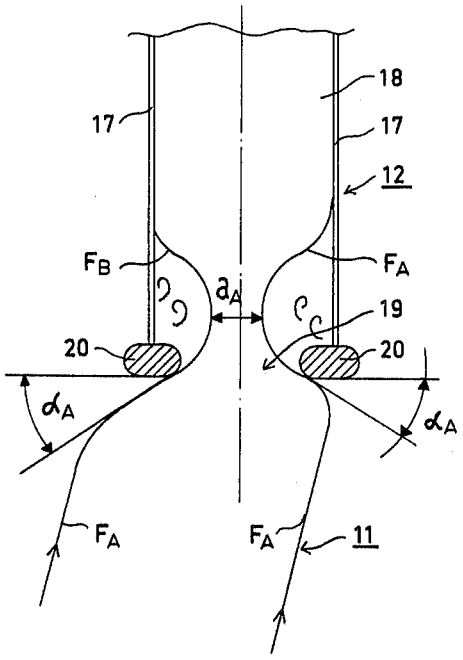
FIGS. 1 and 2 respectively illustrate schematically the effects of changes in the direction of flow of pulp stock from an equalizing chamber into the turbulence passages.

The details with respect to the physical circumstances forming the background of the stabilizing system of the invention and the main principles thereof are referred to below. Initially reference is made to FIG. 5 which shows the primary components of the headbox system which includes the structure of the invention. Thus, referring to FIG. 5 it will be seen that the headbox 10 illustrated therein includes an equalizing chamber means 11 which has a substantially rectangular cross section in a direction at right angles to the direction of pulp stock flow F, or in other words in a plane perpendicular to the plane of FIG. 5. The pulp stock flow arrives in the equalizing chamber means 11 from a system of distribution pipes known in the prior art. Thus, referring to FIG. 12, the inlet portion of the equalizing chamber means 11 is illustrated therein with the upper wall of the equalizing chamber means 11 being omitted from FIG. 12 to show components in the interior of the equalizing chamber means. It will be seen that the equalizing chamber means 11 has a pair of opposed side walls 52 which extend in the direction of pulp stock flow and a transverse rear wall 50 formed with openings which respectively communicate through pipes 58 with a header 56 through which the pulp stock is supplied to the interior of the equalizing chamber means 11.

Returning to FIG. 5, it will be seen that subsequent to the equalizing chamber means 11, in the direction of flow, there are a purality of turbulence passages 12 respectively formed by a plurality of passage-forming means the details of which are set forth below, these passages 12 being constructed, for example, in a manner similar to the lamellar part disclosed in the Finland patent No. 50,260.

Subsequent to the passages 12 of the headbox system 10 there is a tapered transition region 13 which terminates in the lip slice 14 from which the pulp stock discharges onto the wire of the paper machine. Thus, the transition region 13 is situated between the slice 14 and the passages 12 and tapers in a vertical direction so that the depth of the passage through which the pulp stock flows gradually diminishes from the turbulence passages 12 toward the slice 14.

The equalizing chamber means 11 as well as the several passages 12 include an upper substantially horizontal wall 15 which forwardly of the passages 12 tilts downwardly slightly so as to provide the taper for the transition region 13 as described above. These parts of the system also include a lower wall structure 16 which is horizontal, this lower wall structure 16 forming the bottom wall of the equalizing chamber means 11 as well as a lower wall common to the several passages 12 and the lower wall of the transition region 13.

Figure 12:
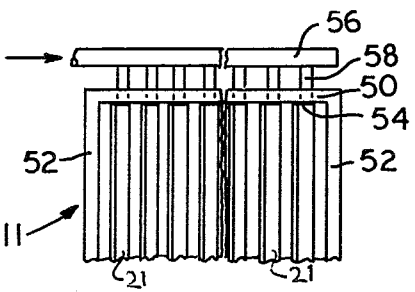
FIG. 12 is a schematic plan view of that part of the equalizing chamber which is distant from and situated at the left of FIG. 5, with the upper wall structure of the equalizing chamber being omitted from FIG. 12.
Figure 5:
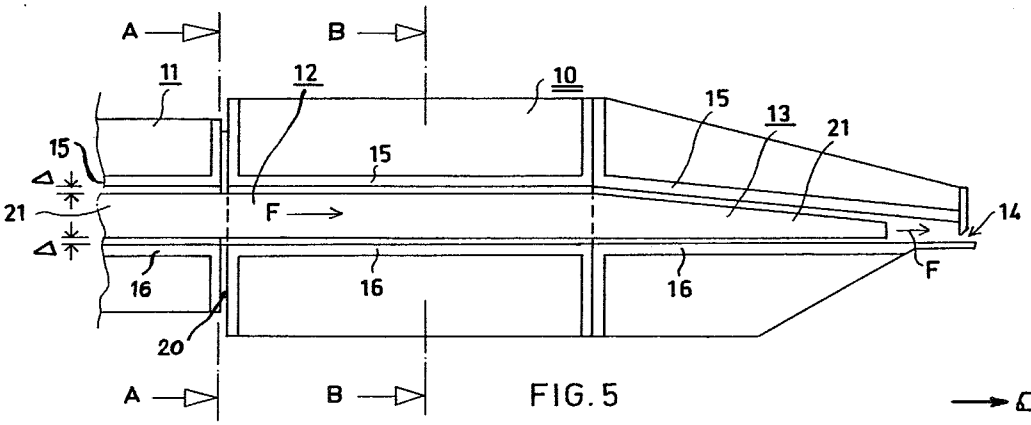
FIG. 5 is a schematic vertical section taken in a vertical plane which extends in a direction of flow with FIG. 5 showing schematically a headbox to which the system of the invention is applied.

Thus, the equalizing chamber means 11 will receive pulp stock from the system of distribution pipes shown in FIG. 12 and will deliver this pulp stock to the outlet end of the equalizing chamber means, this outlet end being situated next to the left inlet ends of the several passages 12, as viewed in FIG. 5. Between the outlet end of the equalizing chamber means 11 and the inlet ends of the several passages 12 there is a throttling means 20 formed by an upright plate formed with apertures 19 passing therethrough, these apertures respectively being aligned with the several passages 12 while the areas of the openings 19 are of course smaller than the cross-sectional areas of the passages 12, so that the throttling means 20 serves to restrict the flow F from the equalizing chamber means into the hollow interiors 18 of the several passages 12.

Figure 7:
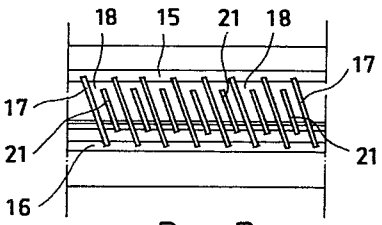
FIGS. 6 and 7 are respectively fragmentary sectional transverse views taken along lines A—A and B—B of FIG. 5 in the direction of the arrows.

As may be seen from FIG. 7, the passage-forming means, which forms the passages 12, includes the upper and lower walls 15 and 16 which are common to and extend across the several passages 12. Between the upper and lower walls 15 and 16 there are side walls 17 which are inclined as illustrated in FIG. 7, so that the upper edges of the walls 17, which are fixed with the upper wall 15, are horizontally offset with respect to the lower edges thereof. Thus, each pair of adjoining passages 12 has the hollow interiors 18 thereof separated from each other by a wall 17 which is common to each pair of adjoining passages 12. Thus the hollow interiors 18 of the passages 12 are defined by the upper wall 15, the lower wall 16, and the several partitions or side walls 17.

In accordance with the present invention there is provided a flow-guide means which serves to guide the pulp stock flowing in the direction F. This flow-guide means of the invention includes a plurality of elongated strips 21 which may be made of relatively thin elongated portions of suitable metal or plastic. These strips 21 which form the flow-guide means of the invention are fixed to the wall 50 for example by being welded thereto as shown by the weldment lines 54 in FIG. 12. Thus, from the inlet region of the equalizing chamber means 11 where the pulp stock first enters into the equalizing chamber means 11 the several strips 21 extend forwardly in the direction of flow F first along the entire length of the equalizing chamber means 11 and then respectively through the several apertures 19 of the throttling means 20 from where the several strips 21 extend along the several hollow interiors 18 of the turbulence passages 12, these strips 21 extending all the way into the transition region 13. Even at the transition region 13 the strips 21 extend along a considerable portion thereof terminating actually at a relatively short distance behind the slice 14, as is shown most clearly in FIG. 5. It will be noted that in the transition region 13 the strips 21 taper in their width so as to conform to the vertical taper of the transition region 13. According to a preferred construction the several strips 21 are fixed only at their ends distant from the slice 14. In other words, the several strips 21 are supported and mounted exclusively at the wall 50 indicated in FIG. 12. Furthermore, the vertical dimension of the several strips 21 is such that the upper and lower edges thereof are spaced from the upper wall 15 and lower wall 16, respectively, so as to form in this way the gaps Δ indicated in FIG. 5. Thus, because of the presence of these gaps, it is possible for the pulp stock to flow transversely across the upper and lower edges of the strips 21 which form the flow-guide means of the invention.

Figure 6:
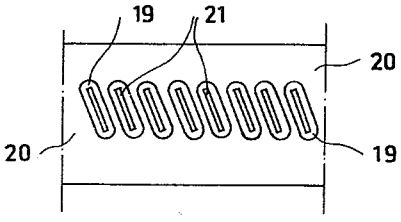

As is apparent from FIG. 6, the several apertures 19 are elongated and inclined in the same way as the walls 17 which are shown in FIG. 7, and in addition the several strips 21 are parallel to while situated midway between the walls 17.

The general operation of the headbox system of the invention and the physical phenomena forming the basis of the invention are described below in connection with FIGS. 1, 2 and 5.

The purpose of the equalizing chamber means 11 of the headbox system 10, as shown in FIG. 5, is to guide the flowing pulp stock which enters from the distribution pipe system indicated, by way of example, in FIG. 12. This pulp stock received from the pipe system is guided by the equalizing chamber means 11 into the system of turbulence passages 12 in such a way that the velocity profile across the width of the paper machine, or in other words transversely to the direction of flow F, will be as uniform as possible. In other words, the velocity of the pulp stock should be the same at all parts of the flowing pulp stock which flows through a vertical plane which extends perpendicularly across the machine, in a direction perpendicular to the direction of flow F. The shearing or friction forces which act in the direction of flow F within the equalizing chamber means 11 do indeed bring about an efficient equalization of the velocity profile, or in other words prevent any substantial variation in velocity across the entire cross section of flow, if in fact the equalizing chamber means 11 is of a sufficient length. However, in a sufficiently long equalizing chamber there is a flow state which in addition to providing a turbulence which is advantageously relatively small, nevertheless experiences a direction of flow which changes with the passage of time, at a comparatively slow rate, as the pulp stock enters from the equalizing chamber means 11 into the turbulence passages 12. These variations in the direction of flow have proved to be a serious drawback with respect to achieving the desired stability of flow at the slice 14. Experience has shown that the configuration of the apertures 19 of the throttling means are immaterial with respect to the variations in direction of flow of the pulp stock entering into the passages 12. Thus, the apertures 19 shown in FIG. 6 may be circular or rectangular or have any other equivalent configuration without providing any influence on the directional variations of the flow entering the passages 12, these different directions of flow creating different detachment of the pulp stock at the edges which define the entrance apertures 19 so as to result undesirably in different constriction coefficients at the apertures, this latter coefficient being defined as the ratio between the effective flow aperture and the actual area of an aperture such as the aperture 19. Thus, this latter constriction coefficient will vary in time as a function of a change in the direction of flow.

Figure 2:
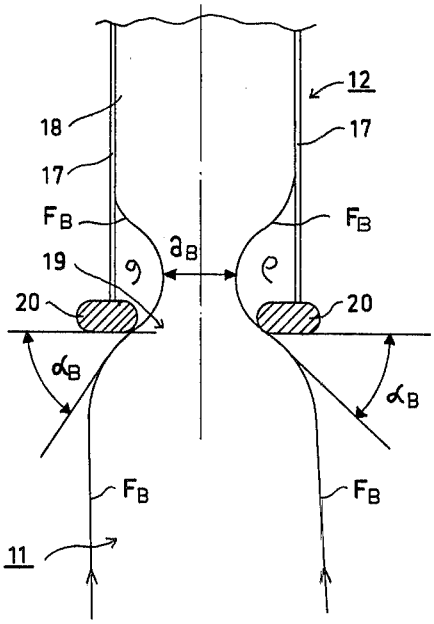

A demonstration of this effect is illustrated in FIGS. 1 and 2. Since the effective velocity of the flow F in the apertures 19 always increases to an extent which is less than proportional to the decrease in the cross section of flow resulting from the presence of the throttling aperture, variations of the flow rate in the interiors 18 of the system of turbulence passages 12 cannot be avoided. In other words, the increase in the velocity of flow F through the throttling apertures 19 does not fully compensate for the constriction of the cross section of the flow F resulting from the presence of the apertures 19. This relationship is illustrated by way of the following energy equation:

$$v_2 = \sqrt{\frac{\Delta p}{\frac{1}{2}\rho\left\{\left[\frac{1}{HP} - 1\right]^2 + K_1 - K_2\right\}}} \qquad (1)$$

where:

$v_2$ = flow velocity in the turbulence passage 18
$\Delta p$ = differential pressure in turbulence passage 18 = constant
$\rho$ = density of the liquid
$P$ = geometric aperture ratio at the entrance edge of passage 18 and in the passage 18
$P = (D_o/D_p)^2$ (for a system of round passages)
$D_o$ = aperture diameter at the entrance edge of passage 18
$D_p$ = diameter of the passage 18
$H$ = constriction coefficient = $(a/D_o)^2$
$a$ = constricted diameter of the flow
$K_1$ = dimensionless friction resistance coefficient of the passage = $\xi L/D_e$
$\xi$ = coefficient of friction
$L$ = length of the passage 18
$D_e$ = "friction diameter" of passage 18
$K_2$ = discharge loss coefficient $\approx [v_L - v_P/v_L]^2$
$v_P$ = velocity after discharge.

The above equation is an exact representation of the effect exerted by the constriction coefficient K on the velocity of flow F in the interior 18 of the passages 12 when the constriction factor changes very slowly. However, the same equation also represents the dynamic process with an accuracy which becomes greater as the frequency of variation slows down and with a decreasing magnitude of the last two terms in the wavy parentheses as compared with the first term. In order to simplify the above relationship, the effect of inertia forces have not been included in the equation. These forces have little influence in the frequency range which has been found to be important in practice: $f < l$ $s^{-1}$.

Referring now to FIGS. 1 and 2, it is apparent then when the flow F is constricted by a discontinuous change in the cross-sectional area of flow (as provided by an aperture 19 of the plate 20,) the effective flow area will always decrease if the rounding radius of the throttling edge is considerably smaller than the diameter of the passage situated subsequent to the constriction. As has been indicated above, the true change of the cross-sectional area of flow depends moreover on the direction in which the flow encounters the constriction. In FIGS. 1 and 2, this situation has been illustrated in connection with a pair of flows $F_A$ and $F_B$ which are indicated in FIGS. 1 and 2 and which respectively have different directions. Thus, the flow $F_A$ meets the aperture 19 of the plate 20 at the angle $\alpha_A$ while the direction of flow $F_B$ in FIG. 2 meets the aperture 19 of the plate 20 at the illustrated angle $\alpha_B$. As is apparent from a comparison of FIGS. 1 and 2, the more oblique the angle at which the flow F impinges on the constriction provided by the plate 20, the more the cross-sectional area of flow is constricted. Thus, it will be seen that the angle $\alpha_B$ is greater than the angle $\alpha_A$, and correspondingly the constriction provided in FIG. 2 is not as great as that resulting from the direction of flow of FIG. 1, which is to say the cross-sectional area of flow $a_B$ shown in FIG. 2 is greater than the cross-sectional area of flow $a_A$ shown in FIG. 1. Thus, when a turbulent flow meets the throttling means 20, the quantity of fluid which will pass through the throttling means will vary with time, inasmuch as with the passage of time the direction of flow changes in a manner apparent from a comparison of FIGS. 1 and 2. It is the elimination of this latter drawback which is the primary object of the present invention.

In accordance with the invention, as illustrated in FIGS. 3–11, through the entire equalizing chamber 11 and through the system of turbulence passages 12 there are the elongated guide strips 21 forming the flow-guide means of the invention, these strips 21 being fixed only at their upstream ends to the inlet end of equalizing chamber means 11, as described above. The number of strips 21 are equal to the number of passages 12 so that the several hollow interiors 18 of the passages 12 have the strips 21 respectively extending therethrough. These strips 21 are of course spaced sufficiently from the top and bottom walls 15 and 16 to provide for the necessary transverse flow, as set forth above.

At the inlet ends of the turbulence passages 12, particularly at the apertures 19 of the throttling means 20, the several strips 21 extend through the apertures 19 throughout nearly the entire vertical height thereof so as to guide the pulp stock flow in an ideal manner into the hollow interiors 18 of the passages 12, the relationships of the strips 21 to the apertures 19 being most clearly illustrated in FIG. 6.

As has been indicated above, the guiding strips 21 extend, preferably, through a comparatively great distance along the interior of the transition region 13, thus guiding the flow F and producing a favorable turbulence so as to be capable in this way of dispersing clumps or bundles of fibers. Inasmuch as the strips 21 are spaced far enough from the stationary boundary surfaces formed by the upper and lower walls 15 and 16, and this upper and lower spacing also being present in transition region 13, the trailing vortices from the strips 21 cannot cause undesirable effects such as, for example, streak effects, so that as a result with the structure of the invention there will be no undesirable effects such as streak effects proceeding along the boundary surfaces of the passages up to the slice 14. A further advantage of the strips 21 resides in the fact that the stationary system of the turbulence passages 12 may, in view of the presence of the strips 21, be made wider than would otherwise be possible, and it is therefore possible through this expedient to avoid an undesirable increase in cost for the structure of the invention. In fact it may be possible by way of the present invention to achieve a construction cost which is less than the cost of a conventional structure, as a result of the fact that the walls 17 can be spaced further apart from each other by reason of the fact that the strips 21 are situated therebetween. One of the most surprising and remarkable advantages achieved by way of the structure of the invention resides in the fact that the improvement of the stability is brought about without any substantial increase in the pressure loss in the headbox, so that there is no increase in the operating cost of the headbox of the invention. These strips 21 are preferably made of a material which is of a relatively light weight while at the same time being of sufficient rigidity. This feature results in a highly effective guidance for the flow F, while even when the operation of the machine is terminated, the strips 21 will have additional support from the fixed structure of the passage-forming means, namely the walls 15, 16, and 17, so that there is no possibility of fouling of the strips 21 in any way. With respect to cleaning of the structure, the strips 21 should have smooth, slippery surfaces. These strips 21 thus may be made of any substantially rigid plastic material or of any number of metals such as stainless steel, aluminum, etc.

Figure 3:
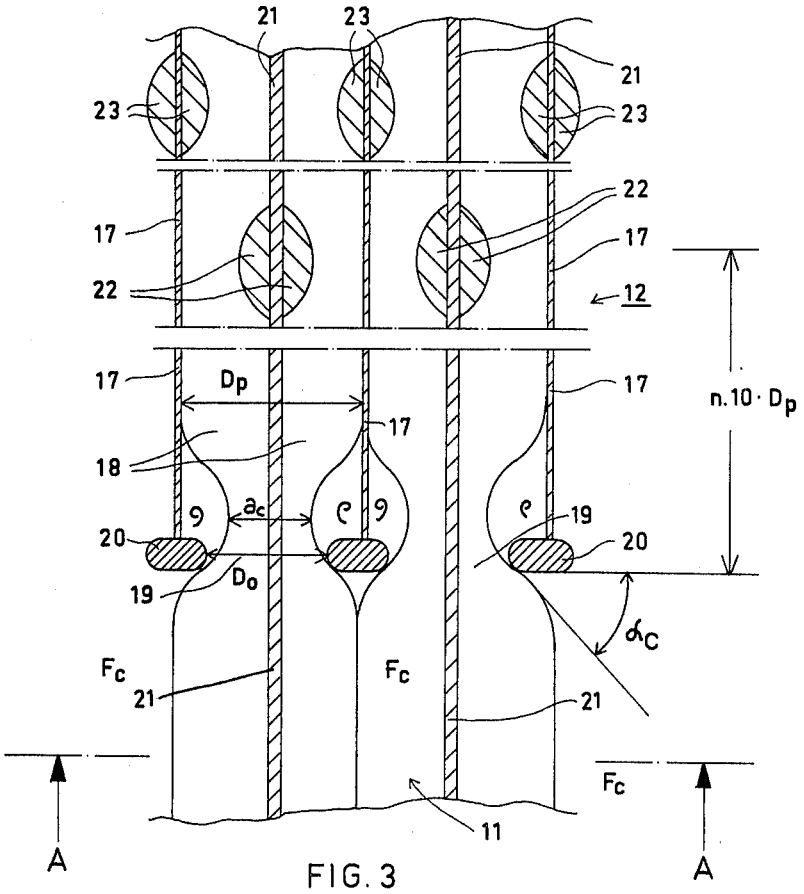
FIG. 3 is a sectional plan view taken in a horizontal plane passing through the region where an equalizing chamber joins the turbulence passages with FIG. 3 illustrating the stabilizing system of the present invention.
Figure 4:
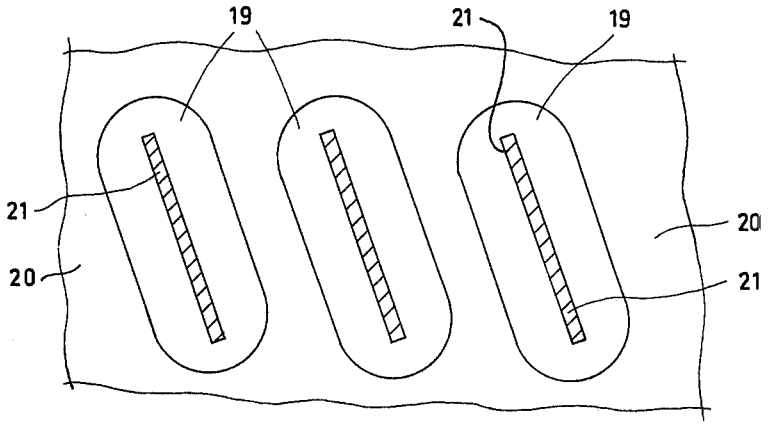
FIG. 4 is a fragmentary vertical section of the structure of FIG. 3 taken along line A—A of FIG. 3 in the direction of the arrows.

A further embodiment of the invention is illustrated in FIGS. 3 and 4 where the apertures 19 of the throttling plate 20 are made relatively large so that the inlet ends of the turbulence passages 12 are made as open as possible with a view to ease of cleaning, with the strips 21 still extending through the apertures 19 and along the interiors 18 of the passages 12 as indicated in FIGS. 3 and 4. However, in this event a considerable additional throttling is provided downstream of the throttling means 20. Thus the interiors of the several passages 12 have discontinuous or localized changes of cross section which produce the additional throttling downstream of the throttling means 20. These localized additional throttling areas are situated at a distance of approximately between 7 and 10 times the maximum cross-sectional dimension $D_p$ of the hollow interior 18 of each passage 12. Thus, in the particular embodiment shown in FIG. 3 each of the strips 21 has fixed to its opposed faces, respectively, a pair of bulging projections 22, and the distance of the throttling projections 22 downstream from the throttling means 20 is between 7 and 10 times the dimension $D_p$, representing the maximum cross-sectional dimension of the interior 18 of each passage 12.

By way of this feature it is possible to increase in the above equation a term of the type $K_2$, while at the same time the constriction coefficient appearing at the throttling means 20 is substantially constant with respect to the flow of pulp stock guided in the hollow interior 18 of each passage 12. Subsequent to the throttling provided by way of the projections 22 which follow the plate 20 in the direction of flow, there is again a straight unthrottled flow through a distance of not less than 7 – 10 times the maximum cross-sectional dimension of the passage, so that in this way it is possible for the throttled flow to settle down. It is to be noted that the turbulence passages 12 terminate at the inlet end of the transition region 13, and the throttling projections such as projections 22 are also situated at a distance of not less than 7 – 10 times the maximum cross-sectional dimension of the passage from the downstream end of the turbulence passages where they meet the transition region 13.

Of course, the construction of this embodiment which is shown in FIGS. 3 and 4 is more expensive than that described above, but this added cost may be worth the facility in cleaning achieved by way of this construction.

As is apparent from FIG. 3, while the guide strips have the throttling projections 22 respectively fixed to opposed faces thereof, it is also possible, in addition, to provide throttling projections 23 which are respectively fixed to the opposed faces of the partitions or side walls 17 which define the passages 18 between themselves. It is of course possible to use both types of projections with the projections 23 being situated at a different location along the path of flow than the projections 22, as is apparent from FIG. 3.

As is indicated in FIGS. 8 – 11, it is also possible to utilize the stabilizing system of the invention in headbox systems where the turbulence passages 12*a*,12*b* are formed by tubes such as the tubes 17*a* and 17*b* illustrated in FIGS. 8 – 11. These tubes 17*a*,17*b* define in their interiors the hollow interior passage spaces 18*a*,18*b*, indicated in FIGS. 9 and 11, respectively. These hollow interiors 18*a*,18*b* also accommodate a flow-guide means of the invention formed in the embodiment of FIGS. 8 and 9 by a vertical guide strip 21*a* situated in each tube 12*a*, while in the embodiment of FIGS. 10 and 11 the flow-guide means includes a guide strip 21*b*, in each tube 17*b*, which is of a cross-shaped cross section having both vertical and horizontal walls, as is apparent from FIG. 11.

Figure 8:
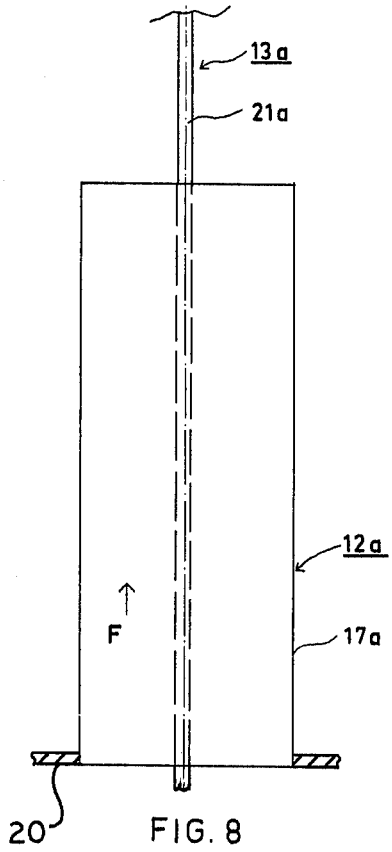
FIG. 8 is a schematic plan view of another embodiment of the invention.
Figure 9:
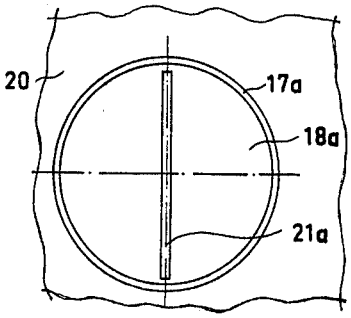
FIG. 9 is a fragmentary elevation of the structure of FIG. 8 as seen when looking toward the lower part of FIG. 8.

Thus, as is apparent from FIGS. 8 and 9, the vertical guide strip 21*a* is flat and extends throughout almost the entire height of the hollow interior 18*a* of the tube 17*a*, this strip 21*a* in each of the series of tubes 17*a* which are situated in a horizontal plane extending longitudinally in the direction of flow beyond each tube 17*a* into the transition region 13*a*, as shown in FIG. 8, while of course these strips 21*a* also extend completely along the entire length of equalizing chamber starting at the wall thereof where the pulp stock first enters into the equalizing chamber, as described above in connection with FIG. 12. As is apparent from FIG. 9, while each strip 21*a* extends throughout almost the entire height of the tube 17*a* in a diametral plane thereof, nevertheless the width of the strip 21*a* is somewhat less than the diameter of the tube 17*a* so that there remains above and below the strip 21*a* the gaps clearly apparent from FIG. 9.

Figure 10:
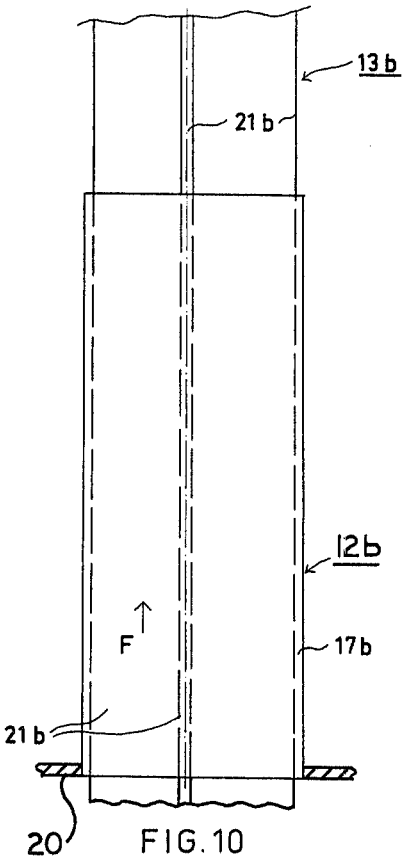
FIG. 10 is a schematic plan view of a further embodiment of the invention.
Figure 11:
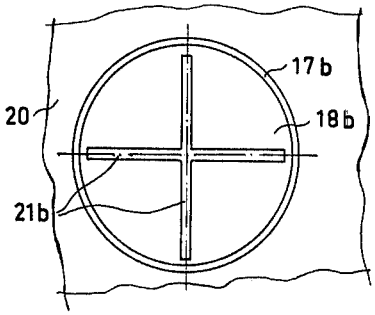
FIG. 11 is a fragmentary elevation showing the structure of FIG. 10 as it appears when looking toward the lower part of FIG. 10.

With the embodiment of FIGS. 10 and 11, the guide strip 21*b* includes not only a vertical wall similar to the strip 21*a* but also a horizontal wall extending transversely across and intersecting the vertical wall to provide the guide strip 21*b* with the cross-shaped cross-sectional configuration clearly apparent from FIG. 11. In this case also the guide strip extends forwardly beyond each tube 17*b* in the direction of flow into the transition region 13*b*, as shown in FIG. 10, and in addition each of the strips 21*b* starts at the wall of equalizing chamber which is most distant from the throttling means 20, as described above and shown in FIG. 12. It is apparent also from FIG. 11 that the outermost edges of the strip 21*b* terminate somewhat short of the inner surface of the tube 17*b* so as to provide gaps between the outermost edges of the strip 21*b* and the inner surface of the tube 17*b*. It is to be noted that the strip 21*b* may be placed in the hollow interior 18*b* of the tube 17*b* at an angular orientation different from that shown in FIG. 11, if desired.

It has been found from experience that with the flow-guide means of the invention, formed by the several different embodiments of guide strips referred to above, it is possible to achieve an operation according to which vortices of a size greater than the spacing between the strips 21 (or 21*a* or 21*b*) will of necessity be straightened out before arriving at the throttling means 20. Moreover, the variation of the cross section of the throttled flow, which otherwise would occur with the passage of time, is eliminated by way of the present invention and instead there is achieved a flow which is uniform even after passage of a considerable length of time, this uniformity being maintained precisely at the point of restriction as well as in the system of turbulence passages following immediately thereafter. Thus, the present invention is applicable to headbox constructions where the pulp stock flow is directed from an equalizing chamber, which may have a rectangular cross section, into a system of turbulence passages formed either by the intersection of flat surfaces or by a group of pipes, with the guide vanes or strips of the invention being provided with a size and configuration conforming to the particular type of turbulence passages utilized.

One of the most important advantages achieved by way of the present invention is the stabilization of flow in the lamellar passages or equivalent pipes, with a resulting uniform square mass distribution in the paper that is manufactured. A further advantage resides in the fact that the open area formed by the openings of the throttling plate, or an equivalent grid plate, where the equalizing chamber and the turbulence passages adjoin each other, can be made as large as possible while at the same time utilizing turbulence passages of the smallest possible dimension. The large open area formed by the relatively large openings of the throttling plate 20 contributes to the stabilization of the flow, while the close spacing of the lamellae or strips enhances the dispersion of flocs in the pulp and helps keep the turbulence passages clean by increasing the shearing stress at the surface of these passages. This latter phenomenon in its turn results in a good formation of the finished paper.

As a third advantage, mention may be made of the better controllability of the headbox flow, without any risk of trailing vortices from the lamellae or the equivalent of the system of turbulence passages, because, in accordance with the invention, the guide strips are disposed so as to extend all the way up to the transition region between the turbulence passages and the lip slice, in such a way that these guide strips are separate from the walls which define the flow passage for the pulp stock and along which the trailing vortices may easily proceed even up to the lip slice or jet, inasmuch as the turbulence dispersing these vortices vanishes in the immediate vicinity of the wall structure which defines the flow passage. A consequence of this last-mentioned advantage is the production of a paper which is free of streaks. As a further advantage associated with the construction of the headbox system of the invention, it may be mentioned that when the system of the present invention is utilized it is possible to employ a fixed, welded basic lamaellar structure which is less expensive than any previously utilized structure while at the same time achieving better results.

Of course, the invention is by no means to be confined to the specific details described above and shown in the drawings, by way of example only, inasmuch as the invention may vary within the inventive concept as defined by the claims which follow below.

What is claimed is:

1. In a headbox system of a paper-manufacturing machine, equalizing chamber means having an outlet end and an interior for receiving pulp stock, from a source such as one or more distribution pipes, and delivering the pulp stock to said outlet end, a slice distant from said equalizing chamber means, a plurality of elongated passage-forming means situated beside each other in a substantially horizontal plane and respectively having inlet ends communicating with said outlet end of said equalizing chamber means for receiving therefrom pulp stock to be directed by said plurality of passage-forming means toward said slice, throttling means situated between said outlet end of said chamber means and said inlet ends of said passage-forming means for throttling the flow of pulp stock from said equalizing chamber means into said plurality of passage-forming means, and flow-guide means extending along the interior of said equalizing chamber means, through said throttling means, and along at least some of said passage-forming means for guiding the pulp stock flowing from said equalizing chamber means into and along said plurality of passage-forming means and for preventing creation of flow-rate variations from changes in the direction of flow of pulp stock from said equalizing chamber means into said plurality of passage-forming means.

2. The combination of claim 1 and wherein said flow-guide means includes a plurality of elongated strips situated within and extending along the interior of said equalizing chamber means and at least some of said passage-forming means, each of said strips having opposed side faces exposed to and engaged by the pulp stock flowing toward said slice.

3. The combination of claim 2 and wherein said equalizing chamber means includes upper and lower walls, said strips being situated between but spaced from said upper and lower walls so that the pulp stock can flow transversely through gaps defined between said strips and upper and lower walls of said equalizing chamber means.

4. The combination of claim 2 and wherein said equalizing chamber means has an end wall distant from said outlet end thereof and said strips being fixed to said end wall to be carried thereby while extending forwardly from said end wall toward and through said throttling means into at least some of said passage-forming means.

5. The combination of claim 2 and wherein said headbox system includes between said plurality of passage-forming means and said slice a transition region which tapers from said plurality of passage-forming means toward said slice in a manner providing for the flow of pulp stock a height which gradually diminishes from said plurality of passage-forming means toward said slice, and said strips extending into said transition region and also tapering therein while terminating in said transition region short of said slice.

6. The combination of claim 2 and wherein the number of said strips equal the number of said passage-forming means and each of the latter having a strip situated therein.

7. The combination of claim 2 and wherein said plurality of passage-forming means includes upper and lower walls extending across and being common to said plurality of passage-forming means and side walls extending between and fixed with said upper and lower walls while being spaced from each other to define between themselves with said upper and lower walls passages formed by said passage-forming means, each pair of adjoining passages formed by said plurality of passage-forming means having a common side wall therebetween, and said side walls being inclined with upper edges of said side walls where they are joined to said upper wall being horizontally offset with respect to lower edges thereof, which are fixed to said lower wall, and said strips respectively extending along the interior of said passages formed by said plurality of passage-forming means and being parallel to said side walls.

8. The combination of claim 7 and wherein said strips are situated midway between said side walls.

9. The combination of claim 2 and wherein said plurality of passage-forming means include a plurality of tubes having hollow interiors along which the pulp stock flows, and said strips extending along the interiors of said tubes, respectively, said strips being respectively situated in diametral planes of said tubes and having a width substantially equal to the diameter of said tubes so that said strips extend substantially all the way across the interiors of said tubes.

10. The combination of claim 9 and wherein said strips are situated in a vertical plane in the interiors of said tubes, respectively.

11. The combination of claim 10 and wherein said strips have not only vertical walls situated in said vertical planes but horizontal walls intersecting and extending across said vertical walls and providing for each strip a substantially cross-shaped cross section.

12. The combination of claim 2 and wherein said strips have in the interior of the passage-forming means into which they extend side surfaces respectively directed toward opposed side surfaces of the passage-forming means in which each strip is located, and at least some of said side surfaces carrying projections which extend therefrom into the path of flow of pulp stock for further throttling the pulp stock flow, so as to increase the discharge loss coefficient in the passage-forming means.

13. The combination of claim 12 and wherein said passage-forming means respectively form a plurality of passages each of which has a predetermined maximum transverse dimension, and said projections being situated downstream of said throttling means at a distance of between 7 and 10 times said maximum dimension.

14. The combination of claim 13 and wherein said plurality of passage-forming means form passages having ends distant from said throttling means, and said projections also being situated in advance of the latter ends of said passages by said distance of between 7 and 10 times said dimension.

15. The combination of claim 1 and wherein said throttling means includes an upright plate respectively formed with openings which are respectively aligned with passages formed by said plurality of passage-forming means, and said openings having, respectively, areas which are smaller than the cross-sectional areas of said passages.

16. The combination of claim 15 and wherein said flow-guide means includes a plurality of strips extending through said openings of said plate of said throttling means.

* * * * *